US007879225B2

(12) United States Patent
Lee et al.

(10) Patent No.: US 7,879,225 B2
(45) Date of Patent: Feb. 1, 2011

(54) ENERGY EFFICIENT AND THROUGHPUT ENHANCING EXTRACTIVE PROCESS FOR AROMATICS RECOVERY

(75) Inventors: Fu-Ming Lee, Katy, TX (US); Kuang-Yeu Wu, Plano, TX (US); Tsung-Min Chiu, Jhonghe (TW); Zong-Ying Chen, Kaohsiung (TW); Jyh-Haur Hwang, Dali (TW); Tzong-Bin Lin, Chiayi (TW); Hung-Chung Shen, Chiayi (TW); Tung-Hsiung Kuo, Tainan (TW); Yu-Ming Wu, Kaohsiung (TW)

(73) Assignees: CPC Corporation Taiwan, Taipei (TW); AMT International, Inc, Plano, TX (US)

( * ) Notice: Subject to any disclaimer, the term of this patent is extended or adjusted under 35 U.S.C. 154(b) by 386 days.

(21) Appl. No.: 12/217,676

(22) Filed: Jul. 8, 2008

(65) Prior Publication Data

US 2009/0255853 A1 Oct. 15, 2009

Related U.S. Application Data

(60) Provisional application No. 61/123,800, filed on Apr. 10, 2008.

(51) Int. Cl.
*C10G 21/28* (2006.01)

(52) U.S. Cl. ..... 208/313; 208/312; 208/321; 585/834; 585/839; 585/857; 585/865; 585/866

(58) Field of Classification Search ..... 208/311–339; 585/834, 839, 857, 865, 866
See application file for complete search history.

(56) References Cited

U.S. PATENT DOCUMENTS 3,179,708 A 4/1965 Penisten (Continued)

OTHER PUBLICATIONS

Written Opinion of International Searching Authority for PCT/US2008/008385 7 pages.

*Primary Examiner*—Walter D Griffin
*Assistant Examiner*—Brian McCaig
(74) *Attorney, Agent, or Firm*—Cascio & Zervas

(57) ABSTRACT

An energy efficient, high throughput process for aromatics recovery can be readily implemented by revamping existing sulfolane solvent extraction facilities, or constructing new ones, so as to incorporate unique process operations involving liquid-liquid extraction and extractive distillation. Current industrial sulfolane solvent based liquid-liquid extraction processes employ a liquid-liquid extraction column, an extractive stripping column, a solvent recovery column, a raffinate wash column, and a solvent regenerator. The improved process for aromatic hydrocarbon recovery from a mixture of aromatic and non-aromatic hydrocarbons requires transformation of the extractive stripping column into a modified extractive distillation column. The revamping incorporates the unique advantages of liquid-liquid extraction and extractive distillation into one process to significantly reduce energy consumption and increase process throughput. The revamp entails essentially only piping changes and minor equipment adjustments of the original liquid-liquid extraction facility, and is therefore, reversible.

37 Claims, 3 Drawing Sheets

U.S. PATENT DOCUMENTS 3,551,327 A 12/1970 Kelly et al.
4,046,675 A 9/1977 Asselin
4,046,676 A 9/1977 Asselin
4,048,062 A 9/1977 Asselin
4,053,369 A 10/1977 Cines
4,058,454 A 11/1977 Asselin
4,081,355 A * 3/1978 Preusser et al. ..... 208/313
4,083,772 A 4/1978 Asselin
4,664,786 A 5/1987 Forte
4,690,733 A 9/1987 Forte
4,693,810 A 9/1987 Forte
5,073,669 A 12/1991 Forte
5,176,821 A 1/1993 Forte
5,336,840 A 8/1994 Forte
5,877,385 A * 3/1999 Lee et al. ..... 585/807
6,303,021 B2 10/2001 Winter
6,800,253 B2 10/2004 Winter

* cited by examiner

ENERGY EFFICIENT AND THROUGHPUT ENHANCING EXTRACTIVE PROCESS FOR AROMATICS RECOVERY

CROSS-REFERENCE TO RELATED APPLICATIONS

This application claims priority to provisional patent application No. 61/123,800 which was filed on Apr. 10, 2008.

FIELD OF THE INVENTION

The present invention is directed to energy efficient processes for aromatics recovery that require significantly less energy but achieve substantially higher throughput relative to current sulfolane solvent based liquid-liquid extraction techniques. The improved process that can be readily implemented by revamping existing sulfolane solvent extraction facilities, or constructing a new one, so as to incorporate unique process operations involving liquid-liquid extraction and extractive distillation.

BACKGROUND OF THE INVENTION

Liquid-liquid extraction (LLE) using sulfolane with water as the extractive solvent is the most important commercial process for purifying the full-range ($C_6$-$C_8$) of aromatic hydrocarbons from petroleum streams, including reformate, pyrolysis gasoline, coke oven oil, and coal tar. U.S. Pat. No. 3,179,708 to Penisten describes an early sulfolane solvent based LLE process that employed an LLE column, a raffinate water washing column (WWC), and a solvent recovery column (SRC). A hydrocarbon feed mixture is contacted in the LLE column with an aqueous sulfolane solvent, which selectively dissolves the aromatic components from the hydrocarbon feedstock, to form a raffinate phase comprising one or more non-aromatic hydrocarbons and an extract phase comprising the solvent and at least one dissolved aromatic compound. The extract phase is transferred to the SRC where the aromatic hydrocarbons are steam stripped from the sulfolane solvent, thereby recovering the components of greatest volatility from the overhead and the purified aromatic product from the side-cut of the SRC. The overhead light components which include aromatics are recycled as a part of the reflux to the LLE column. Finally, water condensate collected from the SRC overhead and side-cut are combined and recycled to the WWC where sulfolane is removed from the raffinate phase to produce a solvent free non-aromatic product.

U.S. Pat. No. 4,046,675 to Asselin disclose a crucial improvement to the earlier LLE processes by incorporating an extractive stripping column (ESC) to remove non-aromatic contaminants from the extract phase of the LLE column before entering the SRC. Non-aromatic components and a significant portion of aromatic components in the LLE extract phase are removed from the ESC overhead and recycled as a liquid reflux to the LLE column. Rich solvent, which contains aromatic components and is virtually free from non-aromatic components, is withdrawn from the bottom of the ESC and fed to the SRC. To enhance ESC operations, an aromatic-containing rich solvent is withdrawn from the SRC side-cut and introduced into the ESC with the LLE extract phase.

The addition of the ESC has been critical to the success of the current LLE process for recovering the full range ($C_6$-$C_8$) aromatic hydrocarbons using aqueous sulfolane as the extractive solvent. However, a major drawback of this process is the high energy (steam) consumption of the ESC, in which all the overhead condensate is recycled to the lower portion of the LLE column as the reflux. In order to maintain the purity of the aromatic product, a substantial amount of energy is needed by the reboiler to vaporize and remove nearly all non-aromatic hydrocarbons from the bottom of the ESC. As a result of this requirement, the overhead vapor from the ESC can contain as much as 25-30% benzene and nearly 10% heavier aromatics, which are condensed and recycled to the bottom of LLE column as the reflux. Consequently, the recycled benzene and heavier aromatics are extracted by the solvent again in the LLE column and fed back to the ESC. Another significant drawback of current ESC operations is that light non-aromatic hydrocarbons ($C_5$-$C_6$), due their higher affinities with the solvent, are continuously accumulated in a closed loop between the top of ESC and the bottom of the LLE column with no way out but consuming a significant amount of vaporization energy. Therefore, this stream has to be purged from time to time in order to keep the process in continuous operation. This large reflux operation not only requires high energy but also creates a bottleneck at the ESC and reduces throughput of the LLE process.

U.S. Pat. No. 5,336,840 to Forte notes that in 1986, the energy costs (comprising steam, electric power and cooling water) for a typical 10,000 barrel per day (or 420,000 metric ton per year) sulfolane solvent based LLE process, amounted to as high as 83%, with solvent make-up charges, labor and maintenance costs making up for the remaining 17% of the total processing costs. In light of the recent drastic increases in oil and natural gas prices, energy costs associated with this process today are significantly higher, thus any reduction in processing energy would be very beneficial.

Various schemes have been proposed and developed with the goal of generating energy savings in the basic process of continuous liquid-liquid extraction for aromatic hydrocarbon recovery and steam stripping for solvent recovery. Most of these schemes which are based on heat integration, such as by using heat exchangers between process streams, pressure reduction devices between process vessels, and the like, have achieved only limited success but with significant increase in equipment costs.

SUMMARY OF THE INVENTION

The present invention is based in part on the discovery that substantial energy savings and enhanced throughput can be realized by making relatively simple changes to existing conventional sulfolane solvent based liquid-liquid extraction (LLE) processes. The revamping of existing facilities requires minimal capital expenditure and downtime as the conversion requires only piping changes and minor equipment adjustments.

In a typical sulfolane solvent based extractive distillation (ED) process for aromatics recovery, solvent is added to an upper portion of the extractive distillation column (EDC) and feed containing aromatic hydrocarbons is introduced to a middle portion of the EDC. As the nonvolatile sulfolane solvent descends through the column, it preferentially extracts the aromatic components to form a rich solvent which moves toward the bottom of the EDC while the non-aromatic component vapor ascends to the top. The overhead vapor is condensed and a portion of the condensate is recycled to the top of the EDC as reflux, while the other portion is withdrawn as the raffinate product. Rich solvent containing solvent and aromatic components is fed to a solvent recovery column (SRC) where the aromatic components are recovered as an overhead product and lean solvent, that is free of the feed components, is recovered as the bottom product, which is recycled to the upper portion of the EDC. A portion of the overhead product is recycled to the top of the SRC as reflux to knock down any entrained solvent in the overhead vapor. The SRC is optionally operated under reduced pressure (vacuum) or with a stripping medium or both to lower the column bottom temperature. Water condensate collected from overheads of both the EDC and the SRC are recycled for generating stripping steam for the SRC. Conventional sulfolane solvent based ED processes are further disclosed in U.S. Pat. No. 3,551,327 to Kelly et al. and U.S. Pat. No. 4,053,369 to Cines, which are incorporated herein by reference.

Sulfolane solvent based ED processes are simpler and consume less energy than LLE processes for aromatic hydrocarbon recovery, however, application of the ED process is constrained by the boiling range of the feedstock. In order to achieve acceptable levels of aromatic purity and recovery, the solvent must essentially keep all the benzene, which is the lightest aromatic compound with a boiling point of 80.1° C., in the EDC bottom. This condition drives virtually all the heaviest non-aromatics into the overhead of the EDC. It would be desirable to position an LLE column in front of the EDC where heavy non-aromatics are preferentially rejected by the extract phase due to their lower polarity so that only aromatics and the lightest non-aromatics are extracted into the extract phase. By feeding this extract phase into an EDC, essentially all the lightest non-aromatics can be distilled into the overhead of the EDC and all the aromatics are recovered in the EDC bottom rich solvent stream, which is then fed to the SRC to recover high purity aromatic products.

Current industrial sulfolane solvent based LLE processes for aromatic hydrocarbon recovery typically employ a liquid-liquid extraction (LLE) column, an extractive stripping column (ESC), a solvent recovery column (SRC), a raffinate water wash column (WWC), and a solvent regenerator (SRG). In implementing the inventive revamping process, one feature is to convert the existing ESC into a modified extractive distillation column (EDC) by merely implementing piping changes to the existing ESC. This simple piping modification, in effect, incorporates the advantages of both the LLE and ED into one process to generate substantial energy savings as well as achieve significant throughput increase for an existing liquid-liquid extraction process for aromatic hydrocarbon recovery. Another feature of the present invention is the elimination of the energy consuming and troublesome LLE reflux, so that the LLE column in the new configuration is operated without a reflux.

In a preferred embodiment, the LLE column is operated under conditions such as to reject all $C_8^+$ non-aromatics and most of the $C_7$ non-aromatics and to allow only $C_5$-$C_6$ non-aromatics and small amounts of $C_7$ non-aromatics to be extracted along with the aromatics into the extract phase. This expected phenomenon is based on the realization that heavier non-aromatics have relatively lower polarity and less affinity with the extractive solvent, and are, therefore, easier to be rejected by the solvent in an LLE column. In operation of the inventive process, the extract phase, which contains the solvent, all the ($C_6$-$C_8$+) aromatics, only $C_5$-$C_6$ non-aromatics, and minor amounts of $C_7$ non-aromatics, is withdrawn from the bottom of the LLE column and transferred to the middle portion of the modified EDC (formerly ESC) as the hydrocarbon feed.

By modified EDC is meant that only a portion of the required lean solvent is introduced to an upper portion of the EDC, while the other portion of the solvent is already in the hydrocarbon feed to the EDC (the solvent-rich extract stream from the LLE column). In a typical (that is, non-modified) EDC, all of the required lean solvent is introduced through the upper portion of the column and the hydrocarbon feed which enters through the middle of the column is solvent free. The function of the modified EDC of the present invention is quite different from that of the ESC. The ESC has only a stripping section since the feed (the solvent-rich aromatic extract phase from the LLE column) is introduced through the top of the column. The ESC strips substantially all of the non-aromatic hydrocarbons for removal through the column overhead so that only aromatic hydrocarbons are in the solvent-rich stream that exits the bottom of the column. For the modified EDC, the same feed is introduced into a middle portion of the column while a portion of the required hydrocarbon-free lean solvent is fed through the upper portion of the column. In this configuration, the modified EDC has both a stripping section, which is below the feed tray, and a rectifying section, which is above the feed tray, to respectively purify both the solvent-rich stream in the column bottom and the non-aromatic raffinate stream in the column overhead.

In order to achieve satisfactory aromatic purity and recovery in the modified EDC, the solvent needs to keep essentially all benzene (the lightest aromatic) in the EDC bottom and virtually all of the heaviest non-aromatics is driven into the overhead of the EDC. In the inventive process, operation of the modified EDC is quite easy since essentially all of the heavy non-aromatics are removed from the EDC feed by the front-end LLE column, thus allowing only $C_5$-$C_6$ non-aromatics with minor amounts of $C_7$ non-aromatics to be present in the feed to the EDC. This is crucial because the existing ESC normally has only 40 to 45 separating trays (or roughly 16 to 18 theoretical trays), which is adequate for the EDC operation when only light non-aromatics is present in the hydrocarbon feedstock. In the absence of heavy non-aromatics and greatly reduced total non-aromatics in the feed, the energy requirement of the modified EDC is substantially reduced as compared to the original ESC.

Since non-aromatics have very limited solubility in the solvent, such as sulfolane, they tend to generate undesirable two liquid phases in the upper portion of the modified EDC. A further feature of the inventive process is to reduce the two liquid phase region in the upper portion of the modified EDC to thereby enhance column performance and operation. This is achieved by greatly reducing the level of non-aromatics in the EDC feed.

Another important feature of the invention is the elimination of the reflux to the top of the modified EDC to further: (1) reduce energy consumption of the column; (2) reduce vapor loading of the upper portion of the column, thereby, increasing the column throughput; and (3) reduce the two liquid phase region in the upper portion of the column, since the reflux contains essentially pure non-aromatics. In an ordinary distillation column, the overhead liquid reflux is essential for generating the necessary liquid phase in the rectifying section of the column which contacts the uprising vapor phase from tray-to-tray for separating the key components in the feed mixture. Depending upon the particular application, normal reflux-to-distillate ratio of an ordinary distillation column is approximately 1 to 20. In the modified EDC, however, the liquid phase in the rectifying section is the nonvolatile, polar solvent, which preferentially absorbs the more polar components (the aromatics) from the uprising vapor phase. This allows the less polar components (the non-aromatics) vapor to ascend to the top of the EDC. It has been demonstrated in a three-meter diameter EDC for benzene, toluene, and xylene (BTX) aromatics recovery that adding reflux to the EDC has no effect in enhancing the separation. In other words, adding reflux to the modified EDC has no effect on the purity and recovery of the overhead product (the non-aromatic raffinate).

DETAILED DESCRIPTION OF THE INVENTION

I. Description of the Conventional LLE Process

Figure 1:
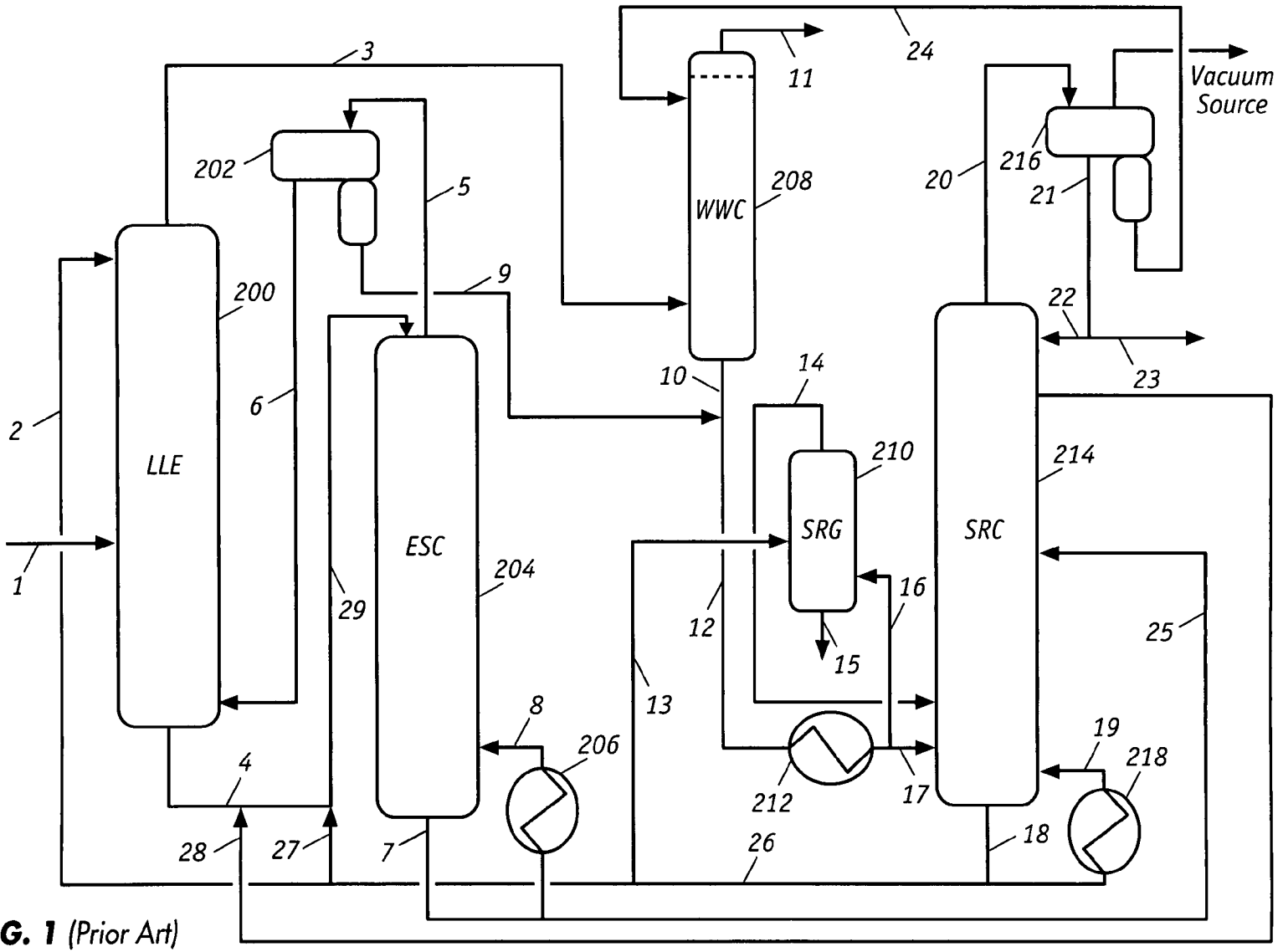
FIG. 1 (Prior Art)
FIG. 1 is a schematic flow process of a prior art liquid-liquid extraction process for aromatics recovery.

Referring to FIG. 1, hydrocarbon feed containing aromatic and non-aromatics is fed via line 1 to the middle portion of LLE column 200, while lean solvent is introduced near the top of LLE column 200 via line 2 to counter-currently contact the hydrocarbon feed. The aromatic hydrocarbons in the feed typically comprise benzene, toluene, ethylbenzene, xylenes, $C_9^+$ aromatics, and mixtures thereof and the non-aromatic hydrocarbons comprise $C_5$ to $C_9^+$ paraffins, naphthenes, olefins, and mixtures thereof. Suitable extractive solvents include, for example, sulfolane, sulfolane with water as co-solvent, tetraethylene glycol (TTEG), TTEG with water as co-solvent, sulfolane and TTEG mixtures, sulfolane and TTEG mixtures with water as co-solvent, triethylene glycol (TEG), TEG with water as co-solvent, sulfolane and TEG mixtures, sulfolane and TEG mixtures with water as co-solvent, and the combinations thereof. A preferred solvent comprises sulfolane with water as the co-solvent. Raffinate phase containing essentially the non-aromatics with a minor amount of solvent is withdrawn from the top of LLE column 200 and fed to a lower portion of water washing column (WWC) 208 via line 3. The extract phase is transferred from the bottom of LLE column 200 via line 4 and is mixed with a secondary lean solvent from line 27 or a rich solvent from the side-cut of solvent recovery column (SRC) 214 from line 28; the combined stream is fed to the top of extractive stripping column (ESC) 204 through line 29.

The vapor flow in ESC 204 is generated by reboiler 206, which is normally heated by steam at a rate that is sufficient to control the column bottom temperature and the overhead stream composition and flow rate. Overhead vapor exiting the top of ESC 204 is condensed in a cooler (not shown) and transferred via line 5 to an overhead receiver 202, which serves to effect a phase separation between the hydrocarbon and the water phases. The hydrocarbon phase, containing the non-aromatics and up to 30-40% benzene and heavier aromatics, is recycled to the lower portion of LLE column 200 as reflux via line 6. The water phase is transferred via lines 9 and 12 to steam generator 212 to generate stripping steam for SRC 214. Rich solvent consists of pure aromatics and the solvent is withdrawn from the bottom of ESC 204 and transferred to the middle portion of SRC 214 via lines 7 and 25. In order to minimize the bottom temperature of SRC 214, receiver 216 is connected to a vacuum source to generate sub-atmospheric condition in SRC 214. Stripping steam is injected from steam generator 212 via line 17 into the lower portion of SRC 214 to assist in the removal of aromatic hydrocarbons from the solvent. An aromatic concentrate, containing water and being substantially free of solvent and non-aromatic hydrocarbons, is withdrawn as an overhead vapor stream from SRC 214 and introduced into an overhead receiver 216 via line 20 after being condensed in a cooler (not shown).

Overhead receiver 216 serves to effect a phase separation between the aromatic hydrocarbon and the water phases. A portion of the aromatic hydrocarbon phase is recycled to the top of SRC 214 as reflux via line 22, while the remainder portion is withdrawn as aromatic hydrocarbon product through line 23. Water phase accumulated in the water leg of overhead receiver 216 is fed via line 24 to an upper portion of WWC 208 as wash water at a location below the interface between the hydrocarbon phase and the water phase near the top of WWC 208. The solvent is removed from the LLE raffinate through a counter-current water wash and the solvent-free non-aromatics, which accumulate in the hydrocarbon phase, are then withdrawn from the top of WWC 208 as solvent-free non-aromatic products through line 11. A water phase, containing the solvent, exits through the bottom of WWC 208 and is fed to steam generator 212 via lines 10 and 12 where it is transformed into stripping steam that is then introduced into SRC 214 via line 17.

A split stream of the lean solvent is diverted and introduced into SRG 210 via line 13 and steam is introduced into SRG 210 through line 16, at a location below the lean solvent feed entry point. Deteriorated solvent and polymeric sludge are removed as a bottom stream through line 15, while the regenerated solvent and substantially all the stripping steam, are recovered as an overhead stream that is introduced into the lower portion of SRC 214 via line 14 as a part of the stripping steam.

II. Description of the Revamped LLE Process (I) for Aromatics Recovery

Figure 2:
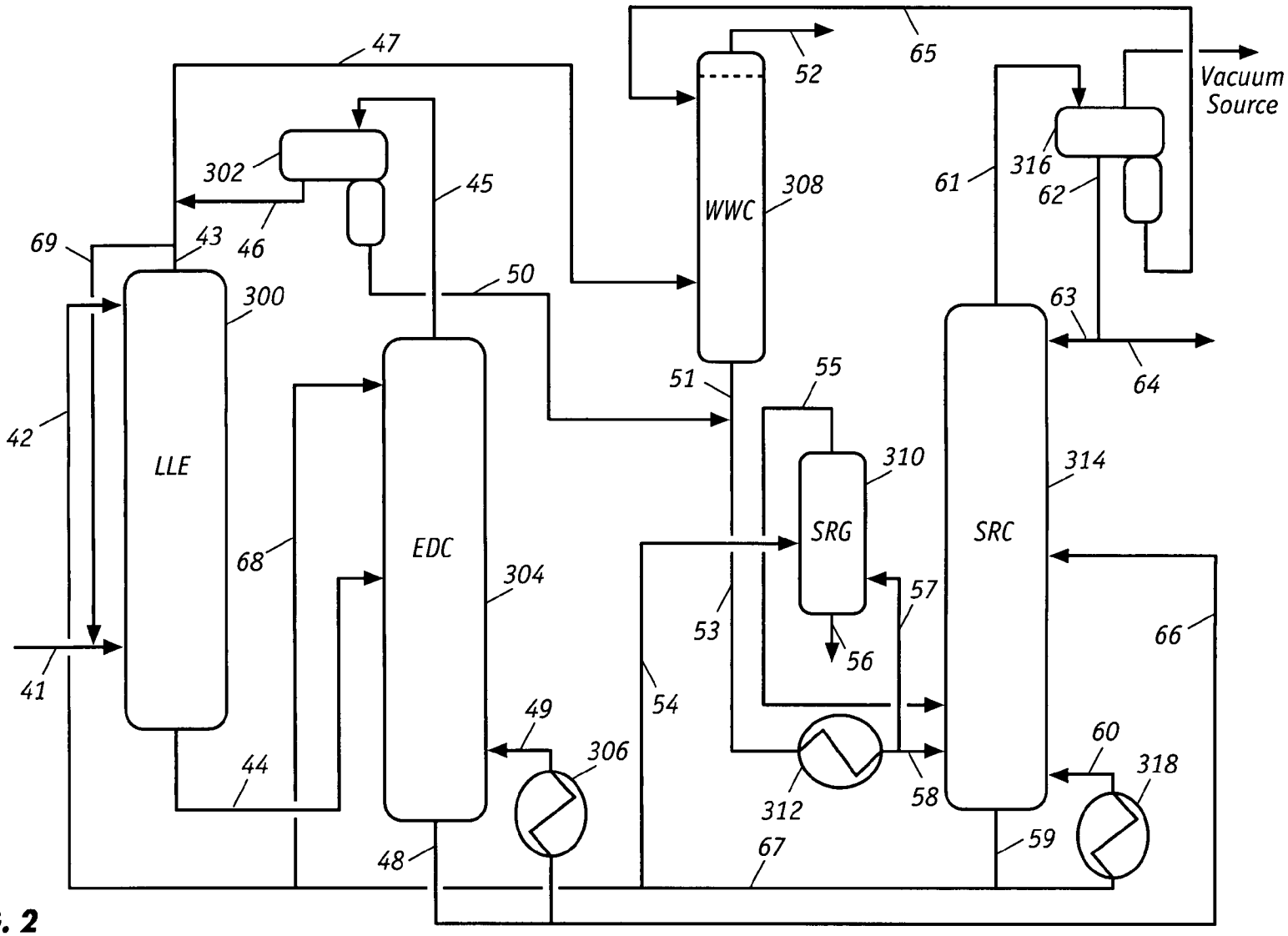
FIG. 2 is a schematic flow process a revamped liquid-liquid extraction process (I) for aromatics recovery.

FIG. 2 illustrates an energy efficient revamped process that is derived by making a few simple modifications to the process shown in FIG. 1. In particular, lines 4, 6, 27 and 28 are eliminated from the scheme shown in FIG. 1 whereas lines 44, 46, 68, and 69 are incorporated. As shown in FIG. 2, LLE column 300 is operated without a liquid reflux as the hydrocarbon feed containing aromatics and non-aromatics is fed to a location near the bottom of LLE column 300 via line 41. The lean solvent is introduced at near the top of LLE column 300 through line 42 to counter-currently contact the hydrocarbon feed. Suitable extractive solvents include, for example, sulfolane, sulfolane with water as co-solvent, tetraethylene glycol (TTEG), TTEG with water as co-solvent, sulfolane and TTEG mixtures, sulfolane and TTEG mixtures with water as co-solvent, triethylene glycol (TEG), and TEG with water as co-solvent, sulfolane and TEG mixtures, sulfolane and TEG mixtures with water as co-solvent, and the combinations thereof. Preferred solvents include sulfolane with water as the co-solvent, and TTEG with water as the co-solvent. Operating conditions of LLE column 300 are adjusted to yield a raffinate phase containing non-aromatics with essentially no aromatic impurities and a minor amount of solvent, and an extract phase containing the solvent, essentially all the aromatics in the hydrocarbon feed, and the $C_5$-$C_6$ non-aromatics with only minor amounts of $C_7$ non-aromatics.

The extract phase is transferred from the bottom of LLE column 300 and is fed to the middle portion of a modified extractive distillation column (EDC) 304 through line 44. EDC 304 is a modified EDC because only a portion of the required lean solvent is introduced to the upper portion of the EDC while the other portion of the solvent is already in the hydrocarbon feed to the EDC (the extract stream from the LLE column 300). In contract, in a typical EDC all the required lean solvent is introduced to the upper portion of the column and the hydrocarbon feed that is fed to the middle portion of the column is solvent free. Modified EDC 304 can employ the same ESC 204 unit as shown in FIG. 1 but accommodating the different stream arrangements. To enhance the performance of modified EDC 304, the original trays in ESC 204 may be replaced with the newer high capacity trays to better handle the two liquid phase phenomena in the upper portions of modified EDC 304.

A raffinate phase is withdrawn from the top of LLE column 300 via line 43. A separate stream of lean solvent is fed to the upper portion of modified EDC 304, preferably at the top tray of modified EDC 304 through line 68. Vapor flow in modified EDC 304 is generated by reboiler 306, which is normally heated by steam at a rate that is sufficient to control the column bottom temperature and the overhead stream composition and flow rate. Overhead vapor exiting the top of modified EDC 304 is condensed in a cooler (not shown) and then transferred via line 45 to overhead receiver 302, which serves to effect a phase separation between the hydrocarbon phase and the water phase. The hydrocarbon phase, which contains the non-aromatics with minor amounts of benzene (preferably less than 2 wt %) and traces of entrained solvent, is withdrawn from overhead receiver 302 via line 46 and is mixed with the raffinate stream from LLE column 300. The combined stream is fed to the lower portion of WWC 308 through line 47. No hydrocarbon phase from overhead receiver 302 is recycled as reflux to modified EDC 304 or LLE column 300. The water phase from overhead receiver 302 is transferred via lines 50 and 53 to steam generator 312 where it is transformed into stripping steam for SRC 314. Rich solvent consists of pure aromatics and the solvent is withdrawn from the bottom of modified EDC 304 and is transferred to the middle portion of SRC 314 via lines 48 and 66.

Operation of SRC 314, WWC 308, and SRG 310 are essentially unchanged from those of corresponding SRC 214, WWC 208 and SRG 210 in the conventional LLE process as depicted in FIG. 1, although operational adjustments may be needed to take full advantage of the revamped process with its attendant lower energy requirements and higher throughput. Typically, the weight ratio of polar solvent that is introduced into the modified EDC to that which is introduced into the LLE column ranges from 0.1 to 10 and preferably the ratio ranges from 0.5 to 1.5. The extraction temperature and pressure of the LLE column are typically maintained at between 20 to 100° C. and between 1.0 to 6.0 Bar, respectively, and preferably are maintained at between 50 to 90° C. and between 4.0 to 6.0 Bar, respectively. The reboiler temperature and pressure of the modified EDC are typically maintained at between 120 to 180° C. and between 1.0 to 2.0 Bar, respectively, and preferably between 130 to 150° C. and between 1.0 to 1.5 Bar, respectively.

In preferred embodiments, the LLE column is operated without a liquid reflux near the bottom of the column and/or the modified EDC is operated without liquid reflux near the top of the column. Finally, the modified EDC is preferably operated under conditions as to maximize benzene recovery in the solvent-rich aromatic concentrate stream, whereby substantially all non-aromatic hydrocarbons are driven into the overhead of the modified EDC.

Optionally, a portion of the non-aromatic raffinate stream 43 from LLE column 300 can be recycled via line 69 into hydrocarbon feed stream 41 to LLE column 300. When the non-aromatic reflux from the top of modified EDC 304 to the bottom of LLE column 300 is eliminated, recycling ensures a phase separation between the solvent-rich aromatic extract phase and the non-aromatic raffinate phase when the hydrocarbon feed to the LLE column has a high aromatic content (>70%), such as in the case of pyrolysis gasoline, which is a common feed for aromatic recovery.

III. Description of the Revamped LLE Process (II) for Aromatics Recovery

Figure 3:
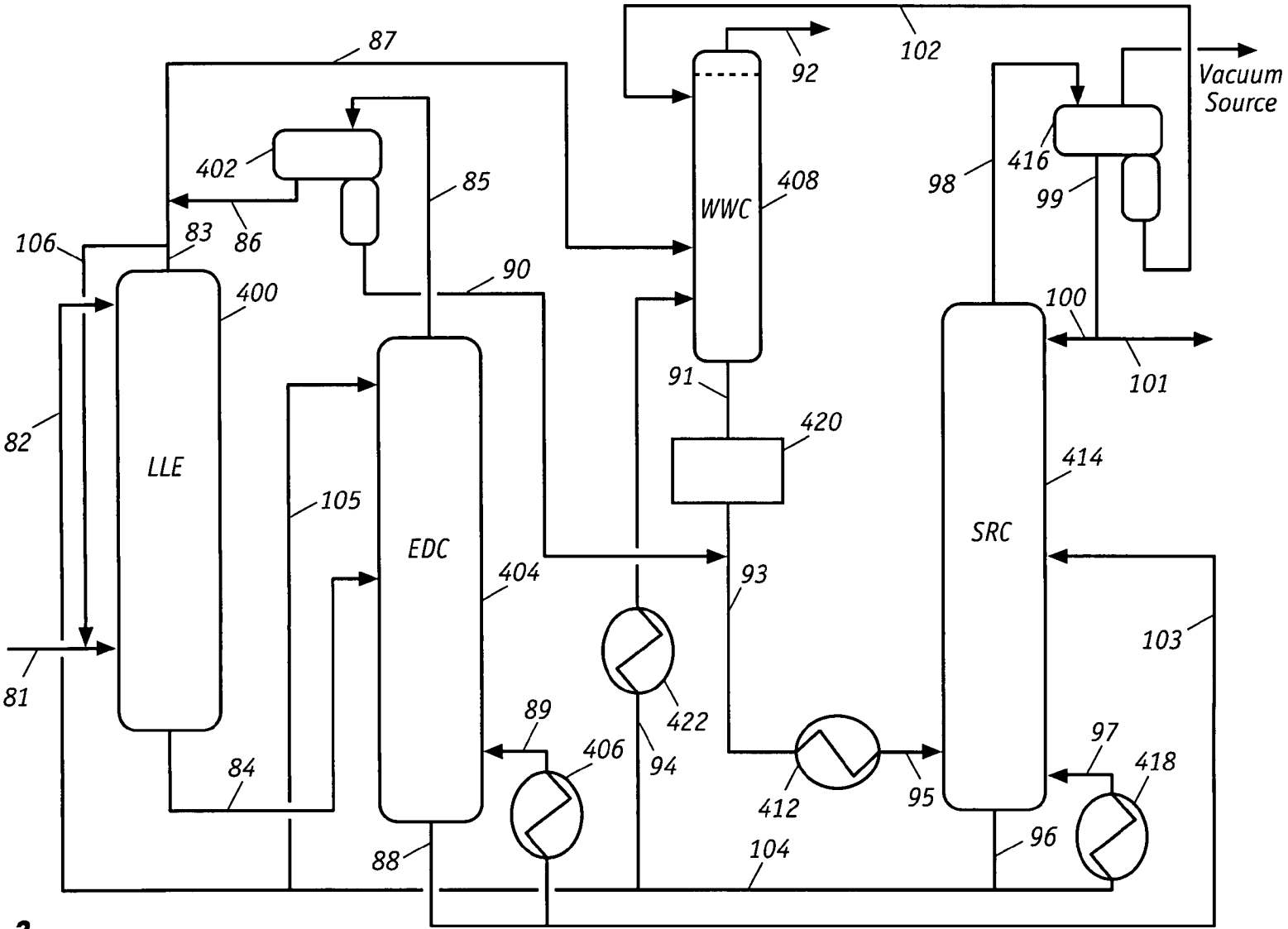
FIG. 3 is a schematic flow process of another revamped liquid-liquid extraction process (II) for aromatics recovery.

The revamped LLE process (I) shown in FIG. 2 can be is further simplified by eliminating the solvent regenerator SRG 310. In the revamped LLE process (II) as illustrated in FIG. 3, WWC 408 functioned not only as the raffinate water wash column but also as the lean solvent regenerator. The lean solvent is withdrawn from the bottom of SRC 414 via lines 96 and 104 and is fed to both LLE column 400 and modified EDC 404 through lines 82 and 105, respectively.

As shown in FIG. 3, LLE column 400 is operated without a liquid reflux as the hydrocarbon feed containing aromatics and non-aromatics is fed to a location near the bottom of LLE column 400 via line 81. Lean solvent is introduced at near the top of LLE column 400 through line 82 to counter-currently contact the hydrocarbon feed. Operating conditions of LLE column 400 are adjusted to yield a raffinate phase containing non-aromatics with essentially no aromatic impurities and a minor amount of solvent, and an extract phase containing the solvent, essentially all the aromatics in the hydrocarbon feed, and the $C_5$-$C_6$ non-aromatics with only minor amounts of $C_7$ non-aromatics.

The extract phase is transferred from the bottom of LLE column 400 and is fed to the middle portion of a modified extractive distillation column (EDC) 404 through line 84. A raffinate phase is withdrawn from the top of LLE column 400 via line 83. A separate stream of lean solvent is fed to the upper portion of modified EDC 404, preferably at the top tray of modified EDC 404 through line 105. Vapor flow in modified EDC 404 is generated by reboiler 406, which is normally heated by steam at a rate that is sufficient to control the column bottom temperature and the overhead stream composition and flow rate. Overhead vapor exiting the top of modified EDC 404 is condensed in a cooler (not shown) and then transferred via line 85 to overhead receiver 402, which serves to effect a phase separation between the hydrocarbon phase and the water phase. The hydrocarbon phase, which contains the non-aromatics with minor amounts of benzene (preferably less than 2 wt %) and traces of entrained solvent, is withdrawn from overhead receiver 402 via line 86 and is mixed with the raffinate stream from LLE column 400. The combined stream is fed to the lower portion of WWC 408 through line 87. No hydrocarbon phase from overhead receiver 402 is recycled as reflux to modified EDC 404 or LLE column 400. The water phase from overhead receiver 402 is transferred via lines 90 and 93 to steam generator 412 where it is transformed into stripping steam for SRC 414. Rich solvent consists of pure aromatics and the solvent is withdrawn from the bottom of modified EDC 404 and is transferred to the middle portion of SRC 414 via lines 88 and 103.

A slip stream of the lean solvent is transferred from line 104 to cooler 422 (newly added equipment) via line 94 and is then fed to the lower portion of WWC 408 at a location that is below the raffinate feed entry point which is connected to line 87. In this fashion, the solvent stays in the water phase in the lower portion of WWC 408 due to its higher density (relative to water). Residual (heavy) hydrocarbons are removed from the lean solvent through the counter-current water wash and accumulate in the hydrocarbon phase along with the non-aromatic raffinate from LLE column 400 and modified EDC 404. The hydrocarbon phase is then withdrawn from the top of WWC 408 as solvent-free non-aromatic products through line 92. Water phase exiting the bottom of WWC 408, which contains the solvent, is passed through a magnetic filter, 420 (a newly added equipment) via line 91 to remove any tramp iron, polymeric sludge, and/or any other highly polar matters. The filtered water stream with minor amounts of solvent is then transferred to steam generator 412 via line 93 where it is transformed into stripping steam to be introduced into SRC 414 via line 95.

Operating conditions in this revamp process are similarly to those for the process shown in FIG. 2. In addition, optionally, a portion of the non-aromatic raffinate stream 83 from LLE column 400 can be recycled via line 106 into hydrocarbon feed stream 81 to LLE column 400.

EXAMPLES OF PREFERRED EMBODIMENTS

The following examples are presented to further illustrate different aspects and embodiments of the invention and are not to be considered as limiting the scope of the invention. Data in Examples 1 and 2 were derived by computer simulation model which was upgraded for improved accuracy via actual commercial process data.

Example 1

Comparative

Base Case

Referring to FIG. 1, one thousand (1,000) Kg/Hr of the hydrocarbon feed at 75° C. and 6.4 Bar (pressure) are fed continuously to the middle portion of LLE column 200 via line 1. This stream contains approximately 25 wt % benzene, 19 wt % toluene, 17 wt % $C_8$ aromatics, 0.5 wt % $C_9^+$ aromatics, and 39 wt % $C_5$-$C_9^+$ non-aromatics. Thirty six hundred (3,600) Kg/Hr of the sulfolane solvent containing 0.8 wt % water at 81° C. and 6.4 Bar are introduced to the upper portion of LLE column 200 via line 2 entering the column at a location below the interface between the raffinate phase and extract phase. Multi-stage counter-current liquid-liquid extraction occurs in LLE column 200 at a temperature of 80° C. and a pressure of 6.4 Bar. The raffinate stream, with only 0.27 wt % $C_8^+$ aromatics and essentially free of benzene and toluene, is withdrawn from the top of the LLE column and transferred to the lower portion of the WWC via line 3 at a flow rate of 397 Kg/Hr. The extract stream, containing 78 wt % sulfolane, 0.6 wt % water, essentially all the aromatics in the LLE hydrocarbon feed, and only 0.31 wt % $C_7^+$ non-aromatics, is transferred from the bottom of the LLE column via line 4, and is mixed with 350 Kg/Hr of the sulfolane solvent (with 0.8 wt % water) from line 27. The mixed stream is fed to the top of ESC 204 through line 29 at a rate of 4,934 Kg/Hr.

Approximately 249,000 Kcal/Hr of the thermal energy, provided by the medium pressure steam to reboiler 206, are required to generate the vapor stream in ESC 204, and to strip essentially all the non-aromatics from the ESC bottom in order to yield the aromatic products with acceptable purity. The ESC bottom temperature is quite high at 173° C. The overhead vapor exits ESC 204 via line 5 and is transferred to overhead accumulator 202 after being condensed by a cooler. The hydrocarbon phase from overhead accumulator 202, containing roughly 25 wt % benzene and 10 wt % $C_7^+$ aromatics, is recycled to bottom of LLE column 200 as the reflux at a flow rate of 380 Kg/Hr via line 6. The recycle stream requires frequent purge to release accumulated $C_5$-$C_6$ non-aromatics. Rich solvent from the bottom of ESC 204, consisting of 86 wt % sulfolane, 0.3 wt % water, and substantially pure $C_6$-$C_9^+$ aromatics, is fed to SRC 214 through lines 7 and 25 at flow rate of 4,534 Kg/Hr, temperature of 173° C. and pressure of 2.3 Bar.

WWC 208 is operated at a temperature of 60-80° C. and a pressure of 1.5 Bar. Water from SRC 214 overhead accumulator 216 is fed to upper portion of WWC 208 to counter-currently extract the sulfolane from the LLE raffinate, at a water-to-raffinate weight ratio of 0.25. Solvent-free raffinate products are removed from the top of WWC 208 at a rate of 388 Kg/Hr through line 11.

The process stream data for LLE column 200, ESC 204, and WWC 208, including the stream composition, flow rate, temperature and pressure are summarized in Table 1.

TABLE 1

Composition of the Original Liquid-Liquid Extraction Process Streams (wt %)

| | Stream No. | | | | |
|---|---|---|---|---|---|
| | 1 | 2 | 3 | 4 | 29 |
| $C_5$ Paraffins | 0.50 | 0.00 | 1.26 | 0.05 | 0.05 |
| $C_5$ Naphthenes | 1.10 | 0.00 | 2.78 | 2.55 | 2.37 |
| $C_5$ Isoparaffins | 0.40 | 0.00 | 1.01 | 0.06 | 0.05 |
| $C_6$ Paraffins | 4.91 | 0.00 | 12.38 | 0.14 | 0.13 |
| $C_6$ Naphthenes | 6.11 | 0.00 | 15.41 | 2.00 | 1.86 |
| $C_6$ Isoparaffins | 6.41 | 0.00 | 16.17 | 0.31 | 0.29 |
| Benzene | 25.25 | 0.00 | 0.00 | 7.64 | 7.10 |
| $C_7$ Paraffins | 2.51 | 0.00 | 6.32 | 0.02 | 0.01 |
| $C_7$ Naphthenes | 2.61 | 0.00 | 6.57 | 0.14 | 0.13 |
| $C_7$ Isoparaffins | 10.82 | 0.00 | 27.29 | 0.16 | 0.15 |
| Toluene | 18.94 | 0.00 | 0.02 | 4.68 | 4.35 |
| $C_8$ Paraffins | 0.70 | 0.00 | 1.77 | 0.00 | 0.00 |
| $C_8$ Naphthenes | 1.30 | 0.00 | 3.28 | 0.00 | 0.00 |
| $C_8$ Isoparaffins | 1.20 | 0.00 | 3.03 | 0.00 | 0.00 |
| $C_8$ Aromatics | 16.63 | 0.00 | 0.23 | 3.79 | 3.52 |
| $C_9^+$ Paraffins | 0.10 | 0.00 | 0.24 | 0.00 | 0.00 |
| $C_9^+$ Aromatics | 0.50 | 0.00 | 0.04 | 0.11 | 0.10 |
| Sulfolane | 0.00 | 99.20 | 2.17 | 77.72 | 79.25 |
| Water | 0.00 | 0.80 | 0.02 | 0.63 | 0.64 |
| Flow Rate (Kg/Hr) | 1000 | 3600 | 397 | 4584 | 4934 |
| Temperature (° C.) | 75 | 81 | 80 | 61 | 62 |
| Pressure (Bar) | 6.4 | 6.4 | 5.8 | 5.8 | 2.0 |

| | Stream No. | | | | |
|---|---|---|---|---|---|
| | 5 | 6 | 7 | 9 | 10 |
| $C_5$ Paraffins | 0.56 | 0.59 | 0.00 | 0.00 | 0.00 |
| $C_5$ Naphthenes | 29.19 | 30.69 | 0.00 | 0.00 | 0.00 |
| $C_5$ Isoparaffins | 0.65 | 0.69 | 0.00 | 0.00 | 0.00 |
| $C_6$ Paraffins | 1.62 | 1.71 | 0.00 | 0.00 | 0.00 |
| $C_6$ Naphthenes | 22.97 | 24.15 | 0.00 | 0.00 | 0.00 |
| $C_6$ Isoparaffins | 3.54 | 3.72 | 0.00 | 0.00 | 0.00 |
| Benzene | 24.40 | 25.65 | 5.57 | 0.05 | 0.00 |
| $C_7$ Paraffins | 0.18 | 0.19 | 0.00 | 0.00 | 0.00 |
| $C_7$ Naphthenes | 1.58 | 1.67 | 0.00 | 0.00 | 0.00 |
| $C_7$ Isoparaffins | 1.81 | 1.91 | 0.00 | 0.00 | 0.00 |
| Toluene | 6.34 | 6.66 | 4.18 | 0.00 | 0.00 |
| $C_8$ Paraffins | 0.01 | 0.02 | 0.00 | 0.00 | 0.00 |
| $C_8$ Naphthenes | 0.06 | 0.06 | 0.00 | 0.00 | 0.00 |
| $C_8$ Isoparaffins | 0.02 | 0.02 | 0.00 | 0.00 | 0.00 |
| $C_8$ Aromatics | 2.04 | 2.15 | 3.65 | 0.00 | 0.00 |
| $C_9^+$ Paraffins | 0.00 | 0.00 | 0.00 | 0.00 | 0.00 |
| $C_9^+$ Aromatics | 0.05 | 0.05 | 0.11 | 0.00 | 0.00 |
| Sulfolane | 0.10 | 0.04 | 86.23 | 1.23 | 7.92 |
| Water | 4.86 | 0.04 | 0.27 | 98.70 | 92.05 |
| Flow Rate (Kg/Hr) | 400 | 380 | 4534 | 20 | 108 |
| Temperature (° C.) | 30 | 31 | 173 | 30 | 78 |
| Pressure (Bar) | 6.4 | 6.4 | 2.3 | 1.0 | 1.5 |

TABLE 1-continued

Composition of the Original Liquid-Liquid Extraction Process Streams (wt %)

| | Stream No. | | |
|---|---|---|---|
| | 11 | 24 | 27 |
| $C_5$ Paraffins | 1.29 | 0.00 | 0.00 |
| $C_5$ Naphthenes | 2.84 | 0.00 | 0.00 |
| $C_5$ Isoparaffins | 1.03 | 0.00 | 0.00 |
| $C_6$ Paraffins | 12.65 | 0.00 | 0.00 |
| $C_6$ Naphthenes | 15.75 | 0.00 | 0.00 |
| $C_6$ Isoparaffins | 16.53 | 0.00 | 0.00 |
| Benzene | 0.00 | 0.00 | 0.00 |
| $C_7$ Paraffins | 6.46 | 0.00 | 0.00 |
| $C_7$ Naphthenes | 6.71 | 0.00 | 0.00 |
| $C_7$ Isoparaffins | 27.89 | 0.00 | 0.00 |
| Toluene | 0.02 | 0.00 | 0.00 |
| $C_8$ Paraffins | 1.81 | 0.00 | 0.00 |
| $C_8$ Naphthenes | 3.35 | 0.00 | 0.00 |
| $C_8$ Isoparaffins | 3.10 | 0.00 | 0.00 |
| $C_8$ Aromatics | 0.24 | 0.00 | 0.00 |
| $C_9^+$ Paraffins | 0.24 | 0.00 | 0.00 |
| $C_9^+$ Aromatics | 0.04 | 0.00 | 0.00 |
| Sulfolane | 0.00 | 0.00 | 99.20 |
| Water | 0.06 | 1.00 | 0.80 |
| Flow Rate (Kg/Hr) | 388 | 100 | 350 |
| Temperature (° C.) | 62 | 35 | 80 |
| Pressure (Bar) | 1.5 | 2.0 | 3.0 |

Example 2

The Inventive Process

Revamped Case

This example demonstrates that the energy consumption of the ESC is substantially reduced by converting it into a modified EDC that is operated without reflux and by totally eliminating the reflux from the ESC to the LLE column. In addition to a large reduction in energy consumption, throughput of the revamped process consisting of the LLE and the modified EDC is also significantly increased. Because the revamp can be accomplished with minor piping modifications, the user has the flexibility of reverting to the original process configuration where necessary.

Referring to FIG. 2, one thousand (1,000) Kg/Hr of hydrocarbon feed at 75° C. and 6.4 Bar is fed continuously to a location near the bottom of LLE column 300 via line 41. This stream has essentially the same composition as that of the LLE feed in example 1. Twenty one hundred (2,100) Kg/Hr of sulfolane solvent containing 0.8 wt % water at 81° C. and 6.4 Bar are introduced to the upper portion of LLE 300 via line 42, at a location that is below the interface between the raffinate phase and the extract phase. Multi-stage counter-current liquid-liquid extraction occurs in LLE column 300 at a temperature around 80° C. and a pressure around 6.4 Bar. A non-aromatic raffinate stream, with only 0.50 wt % $C_8^+$ aromatics and essentially free of benzene and toluene, is withdrawn from the top of LLE column 300 and then transferred to the lower portion of WWC 308 via lines 43 and 47 after mixing with the overhead raffinate stream from modified EDC 304. The extract stream, containing 74 wt % sulfolane, 0.6 wt % water, essentially all the aromatics in the LLE hydrocarbon feed, and less than 1.7 wt % $C_7^+$ non-aromatics, is transferred from the bottom of LLE column 300 and then fed to the middle portion of modified EDC 304 through 44 at a rate of 2816 Kg/Hr.

Twenty eight hundred (2,800) Kg/Hr of sulfolane solvent containing 0.8 wt % water from the bottom of SRC 314 are fed through lines 59, 67 and 68 to the upper portion, preferably to the top tray of modified EDC 304 at 80° C. and 3.0 Bar. Thermal energy, provided by the medium pressure steam to reboiler 306, is required to generate the vapor stream in EDC 304, and to strip essentially all the non-aromatics from modified EDC 304 bottom. However, an additional but crucial requirement of modified EDC 304 operations is to keep virtually all the benzene (the lightest aromatic) in the bottom products of modified EDC 304. To achieve these multiple requirements, the bottom temperature of the modified EDC is maintained at only 143° C. (much lower than 173° C. for the original ESC bottom temperature), and the lean solvent flow rate to EDC 304 is kept at a level to maintain an overall solvent-to-feed weight ratio (S/F) of 6.8 (equivalent to solvent-to-feed volume ratio of 4.5). The S/F is higher than that in a typical EDC operation for aromatics recovery, because a large part of the solvent is already in the EDC hydrocarbon feed, which is the extract phase from the bottom of the LLE column. Since the solvent is essentially nonvolatile in this operation due to its high boiling point, increased solvent circulation (higher S/F) does not affect the process energy requirement significantly.

The overhead vapor exits modified EDC 304 via line 45 and is transferred to overhead accumulator 302 after being condensed in a cooler. The hydrocarbon phase from overhead accumulator 302, which contains roughly 1.1 wt % benzene, insignificant heavier aromatics, 0.03 wt % entrained sulfolane and 0.03 wt % water, is mixed via line 46 with the LLE overhead raffinate stream. The mixed non-aromatic stream containing approximately 0.3 wt % benzene is transferred to WWC 308 at a rate of approximately 396 Kg/Hr via line 47. The thermal energy required at modified EDC reboiler 306 is only 169,000 Kcal/Hr, which is substantially lower than that of ESC 204 (FIG. 1) in the base case (249,000 Kcal/Hr). The energy saving is almost 32% by converting ESC 204 into modified EDC 304 without reflux. Elimination of the LLE reflux from modified EDC 304 can substantially increase throughput of the revamped LLE process by 37% ((984-716) Kg/Hr/716 Kg/Hr=37%), assuming the capacity of modified EDC 304 is limited by the vapor flow in the column, and therefore, is the bottleneck of the revamped LLE process.

Stream data of LLE column 300, modified EDC 304, and WWC 308 of the revamped process, including the stream composition, flow rate, temperature and pressure are summarized in Table 2.

TABLE 2

Composition of the Revamped Liquid-Liquid Extraction Process Streams (wt %)

| | Stream No. | | | | |
|---|---|---|---|---|---|
| | 41 | 42 | 43 | 44 | 45 |
| $C_5$ Paraffins | 0.50 | 0.00 | 1.19 | 0.06 | 1.41 |
| $C_5$ Naphthenes | 1.30 | 0.00 | 2.25 | 0.23 | 5.74 |
| $C_5$ Isoparaffins | 0.40 | 0.00 | 0.94 | 0.05 | 1.17 |
| $C_6$ Paraffins | 4.90 | 0.00 | 12.52 | 0.48 | 11.64 |
| $C_6$ Naphthenes | 6.10 | 0.00 | 13.44 | 0.81 | 19.77 |
| $C_6$ Isoparaffins | 6.40 | 0.00 | 15.92 | 0.67 | 16.30 |
| Benzene | 25.20 | 0.00 | 0.00 | 8.95 | 1.09 |
| $C_7$ Paraffins | 2.50 | 0.00 | 6.86 | 0.20 | 4.78 |
| $C_7$ Naphthenes | 2.60 | 0.00 | 6.37 | 0.28 | 6.71 |
| $C_7$ Isoparaffins | 10.80 | 0.00 | 28.58 | 0.95 | 23.24 |
| Toluene | 18.90 | 0.00 | 0.02 | 6.71 | 0.03 |
| $C_8$ Paraffins | 0.70 | 0.00 | 2.01 | 0.05 | 1.10 |
| $C_8$ Naphthenes | 1.30 | 0.00 | 3.60 | 0.09 | 2.24 |

TABLE 2-continued

| Composition of the Revamped Liquid-Liquid Extraction Process Streams (wt %) | | | | | |
|---|---|---|---|---|---|
| $C_8$ Isoparaffins | 1.20 | 0.00 | 3.42 | 0.08 | 1.98 |
| $C_8$ Aromatics | 16.60 | 0.00 | 0.39 | 5.86 | 0.00 |
| $C_9^+$ Paraffins | 0.10 | 0.00 | 0.23 | 0.01 | 0.05 |
| $C_9^+$ Aromatics | 0.50 | 0.00 | 0.08 | 0.17 | 0.00 |
| Sulfolane | 0.00 | 99.20 | 2.17 | 73.76 | 0.10 |
| Water | 0.00 | 0.80 | 0.02 | 0.59 | 2.66 |
| Total Flow (Kg/Hr) | 1000 | 2100 | 284 | 2816 | 115 |
| Temperature (° C.) | 75 | 81 | 80 | 61 | 89 |
| Pressure (Bar) | 6.4 | 6.4 | 5.8 | 5.8 | 1.1 |

| | Stream No. | | | | |
|---|---|---|---|---|---|
| | 46 | 47 | 48 | 50 | 51 |
| $C_5$ Paraffins | 1.45 | 1.26 | 0.00 | 0.00 | 0.00 |
| $C_5$ Naphthenes | 5.90 | 3.28 | 0.00 | 0.00 | 0.00 |
| $C_5$ Isoparaffins | 1.20 | 1.01 | 0.00 | 0.00 | 0.00 |
| $C_6$ Paraffins | 11.97 | 12.37 | 0.00 | 0.00 | 0.00 |
| $C_6$ Naphthenes | 20.32 | 15.38 | 0.00 | 0.00 | 0.00 |
| $C_6$ Isoparaffins | 16.75 | 16.15 | 0.00 | 0.00 | 0.00 |
| Benzene | 1.12 | 0.32 | 4.56 | 0.00 | 0.00 |
| $C_7$ Paraffins | 4.91 | 6.31 | 0.00 | 0.00 | 0.00 |
| $C_7$ Naphthenes | 6.90 | 6.52 | 0.00 | 0.00 | 0.00 |
| $C_7$ Isoparaffins | 23.89 | 27.26 | 0.00 | 0.00 | 0.00 |
| Toluene | 0.03 | 0.02 | 3.43 | 0.00 | 0.00 |
| $C_8$ Paraffins | 1.13 | 1.76 | 0.00 | 0.00 | 0.00 |
| $C_8$ Naphthenes | 2.31 | 3.24 | 0.00 | 0.00 | 0.00 |
| $C_8$ Isoparaffins | 2.03 | 3.03 | 0.00 | 0.00 | 0.00 |
| $C_8$ Aromatics | 0.00 | 0.28 | 3.00 | 0.00 | 0.00 |
| $C_9^+$ Paraffins | 0.05 | 0.18 | 0.00 | 0.00 | 0.00 |
| $C_9^+$ Aromatics | 0.00 | 0.06 | 0.09 | 0.00 | 0.00 |
| Sulfolane | 0.03 | 1.57 | 88.25 | 2.76 | 3.01 |
| Water | 0.03 | 0.02 | 0.66 | 97.23 | 96.98 |
| Total Flow (Kg/Hr) | 112 | 396 | 5501 | 3.0 | 206 |
| Temperature (° C.) | 35 | 68 | 143 | 35 | 61 |
| Pressure (Bar) | 1.0 | 1.0 | 1.4 | 1.0 | 1.5 |

| | Stream No. | | |
|---|---|---|---|
| | 52 | 65 | 68 |
| $C_5$ Paraffins | 1.28 | 0.00 | 0.00 |
| $C_5$ Naphthenes | 3.33 | 0.00 | 0.00 |
| $C_5$ Isoparaffins | 1.03 | 0.00 | 0.00 |
| $C_6$ Paraffins | 12.56 | 0.00 | 0.00 |
| $C_6$ Naphthenes | 15.62 | 0.00 | 0.00 |
| $C_6$ Isoparaffins | 16.41 | 0.00 | 0.00 |
| Benzene | 0.32 | 0.00 | 0.00 |
| $C_7$ Paraffins | 6.41 | 0.00 | 0.00 |
| $C_7$ Naphthenes | 6.63 | 0.00 | 0.00 |
| $C_7$ Isoparaffins | 27.69 | 0.00 | 0.00 |
| Toluene | 0.02 | 0.00 | 0.00 |
| $C_8$ Paraffins | 1.79 | 0.00 | 0.00 |
| $C_8$ Naphthenes | 3.29 | 0.00 | 0.00 |
| $C_8$ Isoparaffins | 3.07 | 0.00 | 0.00 |
| $C_8$ Aromatics | 0.28 | 0.00 | 0.00 |
| $C_9^+$ Paraffins | 0.18 | 0.00 | 0.00 |
| $C_9^+$ Aromatics | 0.06 | 0.00 | 0.00 |
| Sulfolane | 0.00 | 0.00 | 99.20 |
| Water | 0.03 | 1.00 | 0.80 |
| Total Flow (Kg/Hr) | 390 | 200 | 2800 |
| Temperature (° C.) | 42 | 30 | 80 |
| Pressure (Bar) | 1.5 | 2.0 | 3.0 |

The foregoing has described the principles, preferred embodiment and modes of operation of the present invention. However, the invention should not be construed as limited to the particular embodiments discussed. Instead, the above-described embodiments should be regarded as illustrative rather than restrictive, and it should be appreciated that variations may be made in those embodiments by workers skilled in the art without departing from the scope of present invention as defined by the following claims.

What is claimed is:

1. A method for converting an existing sulfolane solvent based liquid-liquid extraction (LLE) process that employs an LLE column, an extractive stripping column (ESC), a solvent recovery column (SRC), a raffinate water wash column (WWC), and a solvent regenerator (SRG) into an improved process for aromatic hydrocarbon recovery from a mixture thereof with non-aromatic hydrocarbons, wherein the existing process includes the steps of: (i) introducing through a first line a hydrocarbon mixture into the LLE column through a middle locus thereof; (ii) introducing through a second line a hydrocarbon-free lean solvent from the bottom of the SRC into the LLE through an upper locus thereof; (iii) transferring through a third line a solvent-rich, aromatic extract from the bottom of the LLE column into the top of the ESC; (iv) withdrawing a non-aromatic raffinate stream from top of the LLE through a fourth line and fed into a lower portion of the WWC; (v) mixing the solvent-rich aromatic extract stream with a secondary lean solvent or a rich solvent from a side-cut of the SRC to form a combined stream that is fed to the top of the ESC through a fifth line; (vi) withdrawing an overhead vapor exiting the top of the ESC and transferring the vapor to a first overhead accumulator that effects a phase separation between a hydrocarbon phase and a water phase, wherein the hydrocarbon phase is recycled through a sixth line to a lower portion of the LLE column as reflux and the water phase is converted into steam which is transferred through a seventh line to the SRC; (vii) transferring a solvent-rich aromatic stream from the bottom of the ESC into a middle portion of the SRC through an eighth line; and (viii) withdrawing an aromatic concentrate from the SRC and transferring the concentrate into a second overhead accumulator that effects a phase separation between an aromatic phase and a water phase wherein a portion of the aromatic phase is withdrawn as product and another portion of the aromatic phase recycled to the SRC as reflux, wherein the conversion comprises the steps of:

(a) installing a ninth line for introducing a portion of a hydrocarbon-free lean solvent from the bottom of the SRC into a modified extractive distillation column (EDC) through an upper locus thereof, wherein the modified EDC is derived by modifying the ESC;

(b) installing a tenth line for introducing a solvent-rich, aromatic extract from the bottom of the LLE column into the modified EDC through a lower locus thereof;

(c) installing an eleventh line for transferring a non-aromatic concentrate from the overhead accumulator of the modified EDC and mixing with a non-aromatic raffinate stream from the top of the LLE column;

(d) eliminating existing line three for introducing the solvent-rich, aromatic extract from the bottom of the LLE column into the top of the modified EDC;

(e) eliminating existing line six for transferring the reflux from the overhead accumulator of the modified EDC into the LLE column through a lower locus thereof;

(f) eliminating an existing line for introducing the hydrocarbon-free lean solvent from the bottom of the SRC into the bottom line of the LLE column containing the solvent-rich, aromatic extract or eliminating an existing line for introducing aromatic-containing rich solvent from the side-cut of the SRC into the bottom line of the LLE column containing the solvent-rich, aromatic extract; and (g) optionally, installing a twelfth line for recycling at least a portion of the non-aromatic raffinate from line four in step (iv) into the hydrocarbon feed stream to the LLE column to enhance phase separation between the aromatic-containing extract phase and the non-aromatic raffinate phase in the column.

2. A process for aromatic hydrocarbon recovery from feed which comprises a hydrocarbon mixture of aromatic and non-aromatic hydrocarbons that comprises the steps of:

(a) introducing the hydrocarbon mixture into a liquid-liquid extraction (LLE) column, through a middle locus thereof, and introducing a portion of lean solvent from the bottom of a solvent recovery column (SRC) into the LLE column, through an upper locus thereof, therein contacting the hydrocarbon mixture with polar lean solvent characteristically selective for extracting aromatic hydrocarbons, at conditions selected to maintain the mixture and solvent in liquid phase;

(b) removing a non-aromatic raffinate stream from the LLE column, through a top locus thereof, and removing a solvent-rich aromatic extract stream from the LLE column, through a bottom locus thereof;

(c) introducing the solvent-rich aromatic extract stream into a modified extractive distillation column (EDC), through a middle locus thereof, and introducing a portion of the polar lean solvent from the bottom of the SRC into the modified EDC, through an upper locus thereof, therein contacting the hydrocarbon mixture with the polar lean solvent characteristically selective for absorbing the aromatic hydrocarbons, at conditions selected to maintain at least a portion of the hydrocarbon mixture in vapor phase and the solvent in liquid phase;

(d) removing a non-aromatic concentrate from the modified EDC, through a top locus thereof, and removing a solvent-rich aromatic concentrate from the modified EDC, through a bottom locus thereof;

(e) combining the non-aromatic concentrate from step (d) with the non-aromatic raffinate stream from step (b) to form a mixture that is introduced into a water wash column (WWC) through a lower, first locus thereof, and introducing at least a portion of water condensate that is collected from an overhead of the SRC into the WWC through an upper, second locus thereof, thereby producing a solvent-free non-aromatic stream through a top, third locus thereof, and removing a water stream containing solvent through a bottom, fourth locus thereof to generate stripping steam through a steam generator;

(f) introducing the solvent-rich aromatic concentrate from step (d) into the SRC, through a middle, first locus thereof, and introducing at least a portion of the steam from step (e) as a vaporous stripping medium into a lower, second locus thereof, and recovering a substantially solvent-free aromatic concentrate through an upper, third locus thereof, and removing a substantially hydrocarbon-free, lean solvent stream from a lower, fourth locus thereof;

(g) introducing at least a portion of the lean solvent stream from step (f) into a solvent regenerator (SRG) through an upper locus thereof, and introducing at least a portion of steam generated from step (e) into the SRG through a lower locus thereof, and withdrawing regenerated solvent, containing substantially all the stripping steam, from the SRG through a top locus thereof, which is then introduced into the SRC through a lower locus thereof; and (h) optionally recycling at least a portion of the non-aromatic raffinate stream from step (b) into the hydrocarbon feed stream to the LLE column to enhance phase separation between the aromatic-containing extract phase and the non-aromatic raffinate phase in the column.

3. The process of claim 2 wherein the aromatic hydrocarbons comprise benzene, toluene, ethylbenzene, xylenes, $C_9^+$ aromatics, and mixtures thereof and the non-aromatic hydrocarbons comprise $C_5$ to $C_9^+$ paraffins, naphthenes, olefins, and mixtures thereof.

4. The process of claim 2 wherein the polar solvent is selected from the group consisting of sulfolane, sulfolane with water as co-solvent, tetraethylene glycol (TTEG), TTEG with water as co-solvent, sulfolane and TTEG mixtures, sulfolane and TTEG mixtures with water as co-solvent, triethylene glycol (TEG), and TEG with water as co-solvent, sulfolane and TEG mixtures, sulfolane and TEG mixtures with water as co-solvent, and the combinations thereof.

5. The process of claim 4 wherein the polar solvent is sulfolane with water as co-solvent.

6. The process of claim 4 wherein the polar solvent is TTEG with water as co-solvent.

7. The process of claim 2 wherein the weight ratio of polar solvent that is introduced into the modified EDC to that which is introduced into the LLE column ranges from 0.1 to 10.

8. The process of claim 7 wherein the weight ratio of polar solvent that is introduced into the modified EDC to that which is introduced into the LLE column ranges from 0.5 to 1.5.

9. The process of claim 2 wherein the LLE column is operated under conditions as to yield a non-aromatic raffinate phase, which contains essentially no aromatic impurities and a minor amount of the solvent and an extract phase, which contains the solvent, essentially all the aromatics in the hydrocarbon mixture feed and the $C_5$-$C_6$ non-aromatics with minor amounts of $C_7$ non-aromatics.

10. The process of claim 2 wherein the extraction temperature and pressure of the LLE column are maintained at between 20 to 100° C. and between 1.0 to 6.0 Bar, respectively.

11. The process of claim 10 wherein the extraction temperature and pressure of the LLE column are maintained at between 50 to 90° C. and between 4.0 to 6.0 Bar, respectively.

12. The process of claim 2 wherein the LLE column is operated without a liquid reflux near the bottom of the LLE column.

13. The process of claim 2 wherein a portion of the non-aromatic raffinate from the LLE column is optionally mixed with hydrocarbon feed to the LLE column.

14. The process of claim 2 wherein the modified EDC is operated under conditions as to maximize benzene recovery in the solvent-rich aromatic concentrate stream, whereby substantially all non-aromatic hydrocarbons are driven into the overhead of the modified EDC.

15. The process of claim 2 wherein the reboiler temperature and pressure of the modified EDC are maintained at between 120 to 180° C. and between 1.0 to 2.0 Bar, respectively.

16. The process of claim 15 wherein the reboiler temperature and pressure of the modified EDC are maintained at between 130 to 150° C. and between 1.0 to 1.5 Bar, respectively.

17. The process of claim 2 wherein the modified EDC is operated without a liquid reflux near the top of the column.

18. A method for converting an existing sulfolane solvent based liquid-liquid extraction (LLE) process that employs an LLE column, an extractive stripping column (ESC), a solvent recovery column (SRC), a raffinate water wash column (WWC), and a solvent regenerator (SRG) into an improved process for aromatic hydrocarbon recovery from a mixture thereof with non-aromatic hydrocarbons, wherein the existing process comprises the steps of: (i) introducing through a first line a hydrocarbon mixture into the LLE column through a middle locus thereof; (ii) introducing through a second line a hydrocarbon-free lean solvent from the bottom of the SRC into the LLE through an upper locus thereof; (iii) transferring through a third line a solvent-rich, aromatic extract from the bottom of the LLE column into the top of the ESC; (iv) withdrawing a raffinate stream from top of the LLE through a fourth line and fed into a lower portion of the WWC; (v) mixing the solvent-rich aromatic extract stream with a secondary lean solvent or a rich solvent from a side-cut of the SRC to form a combined stream that is fed to the top of the ESC through a fifth line; (vi) withdrawing an overhead vapor exiting the top of the ESC and transferring the vapor to a first overhead accumulator that effects a phase separation between a hydrocarbon phase and a water phase, wherein the hydrocarbon phase is recycled through a sixth line to a lower portion of the LLE column as reflux and the water phase is converted into steam which is transferred through a seventh line to the SRC; (vii) transferring a solvent-rich aromatic stream from the bottom of the ESC into a middle portion of the SRC through an eighth line; and (viii) withdrawing an aromatic concentrate from the SRC through a ninth line and transferring the concentrate into a second overhead accumulator that effects a phase separation between an aromatic phase and a water phase wherein a portion of the aromatic phase is withdrawn as product and another portion of the aromatic phase recycled to the SRC as reflux; (ix) diverting lean solvent through a split stream and introducing the diverted lean solvent through a tenth line into the SRG; and (x) introducing steam into the SRG through an eleventh line, wherein the conversion comprises the steps of:

(a) installing a twelfth line for introducing a portion of the hydrocarbon-free lean solvent from the bottom of the SRC into a modified EDC, which is derived by modifying the ESC, through an upper locus thereof;

(b) installing a thirteenth line for introducing the solvent-rich, aromatic extract from the bottom of the LLE column into the modified EDC through a lower locus thereof;

(c) installing a fourteenth line for transferring the non-aromatic concentrate from the overhead accumulator of the modified EDC to mix with the non-aromatic raffinate stream from the top of the LLE column;

(d) installing a fifteenth line for introducing a portion of the hydrocarbon-free lean solvent from the bottom of the SRC into the WWC through a lower locus thereof below the entry point of the non-aromatic raffinate stream;

(e) installing a magnetic filter at the bottom of the WWC;

(f) eliminating existing line three for introducing the solvent-rich, aromatic extract from the bottom of the LLE column into the top of the modified EDC;

(g) eliminating existing line six for transferring the reflux from the overhead accumulator of the modified EDC into the LLE column through a lower locus thereof;

(h) eliminating an existing line for introducing hydrocarbon-free lean solvent from the bottom of the SRC into the bottom line of the LLE column containing the solvent-rich, aromatic extract, or eliminating existing line for introducing aromatic-containing rich solvent from the side-cut of the SRC into the bottom line of the LLE column containing the solvent-rich, aromatic extract;

(i) eliminating the existing SRG and all of its associated lines; and (j) optionally installing a sixteenth line for recycling at least a portion of the non-aromatic raffinate from line four in step (iv) into the hydrocarbon feed stream to the LLE column to enhance phase separation between the aromatic-containing extract phase and the non-aromatic raffinate phase in the column.

19. A process for aromatic hydrocarbon recovery from feed which comprises a hydrocarbon mixture of aromatic and non-aromatic hydrocarbons which comprises the steps of:

(a) introducing the hydrocarbon mixture into a liquid-liquid extraction (LLE) column, through a middle locus thereof, and introducing a portion of polar lean solvent from the bottom of a solvent recovery column (SRC) into the LLE column, through an upper locus thereof, therein contacting the hydrocarbon mixture with the polar lean solvent characteristically selective for extracting aromatic hydrocarbons, at conditions selected to maintain the mixture and solvent in liquid phase;

(b) removing a non-aromatic raffinate stream from the LLE column, through a top locus thereof, and removing a solvent-rich aromatic extract stream from the LLE column, through a bottom locus thereof;

(c) introducing said solvent-rich aromatic extract stream into a modified extractive distillation column (EDC), through a middle locus thereof, and introducing a portion of the polar lean solvent from the bottom of the SRC into the modified EDC, through an upper locus thereof, therein contacting the hydrocarbon mixture with the polar lean solvent characteristically selective for absorbing aromatic hydrocarbons, at conditions selected to maintain at least a portion of the hydrocarbon mixture in vapor phase and said solvent in liquid phase;

(d) removing a non-aromatic concentrate from the modified EDC, through a top locus thereof, and removing a solvent-rich aromatic concentrate from the modified EDC, through a bottom locus thereof;

(e) combining the non-aromatic concentrate from step (d) with the non-aromatic raffinate stream from step (b) and introducing the mixture into the WWC through a lower, first locus thereof, introducing at least a portion of the water condensate collected from the overhead of the SRC into the WWC through an upper, second locus thereof, producing a solvent-free non-aromatic stream through a top, third locus thereof, and removing a water stream containing solvent through a bottom, fourth locus thereof;

(f) introducing at least a portion of the polar lean solvent stream from the bottom of the SRC into the WWC through a fifth locus thereof, which is below the first locus thereof, for removing, through counter-current water wash, any residual hydrocarbons from the polar lean solvent, which are then recovered as a part of the solvent-free non-aromatic stream from the WWC through the top, third locus thereof;

(g) passing the water stream containing solvent from step (e) into a magnetic filter to remove any tramp iron, polymeric sludge, or any other high polar matters, before entering existing steam generator to generate stripping steam for the SRC;

(h) introducing said solvent-rich aromatic concentrate from step (d) into said SRC, through a middle, first locus thereof, introducing at least a portion of said steam from step (g) as a vaporous stripping medium into a lower, second locus thereof, recovering a substantially solvent-free aromatic concentrate through an upper, third locus thereof, and removing a substantially hydrocarbon-free, polar lean solvent stream from a bottom, fourth locus thereof; and (i) optionally recycling at least a portion of the non-aromatic raffinate stream from step (b) into the hydrocarbon feed stream to the LLE column to enhance phase separation between the aromatic containing extract phase and the non-aromatic raffinate phase in the column.

20. The process of claim 19 wherein the aromatic hydrocarbons comprise benzene, toluene, ethylbenzene, xylenes, $C_9^+$ aromatics, and mixtures thereof and the non-aromatic hydrocarbons comprise $C_5$ to $C_9^+$ paraffins, naphthenes, olefins, and mixtures thereof.

21. The process of claim 19 wherein the polar lean solvent is selected from the group consisting of sulfolane, sulfolane with water as co-solvent, tetraethylene glycol (TTEG), TTEG with water as co-solvent, sulfolane and TTEG mixtures, sulfolane and TTEG mixtures with water as co-solvent, triethylene glycol (TEG), TEG with water as co-solvent, sulfolane and TEG mixture, sulfolane and TEG mixtures with water as co-solvent, and combinations thereof.

22. The process of claim 21 wherein the polar lean solvent is sulfolane with water as co-solvent.

23. The process of claim 21 wherein the polar lean solvent is TTEG with water as co-solvent.

24. The process of claim 19 wherein the weight ratio of lean solvent that is introduced into the modified EDC to that which is introduced into the LLE column ranges from 0.1 to 10.

25. The process of claim 24 wherein the weight ratio of lean solvent that is introduced into the modified EDC to that which is introduced into the LLE column ranges from 0.5 to 1.5.

26. The process of claim 19 wherein the LLE column is operated under such conditions as to yield a non-aromatic raffinate phase containing essentially no aromatic impurities and a minor amounts of solvent and an extract phase containing the solvent, essentially all the aromatics in the hydrocarbon feed and the $C_5$-$C_6$ non-aromatics with only minor amounts of $C_7$ non-aromatics.

27. The process of claim 19 wherein the extraction temperature and pressure of the LLE column are maintained at between 20 to 100° C. and between 1.0 to 6.0 Bar, respectively.

28. The process of claim 27 wherein the extraction temperature and pressure of the LLE column are maintained at between 50 to 90° C. and between 4.0 to 6.0 Bar, respectively.

29. The process of claim 19 wherein the LLE column is operated without a liquid reflux near the bottom of the column.

30. The process of claim 19 wherein the modified EDC is operated under such conditions as to maximize the benzene recovery in the solvent-rich aromatic concentrate stream, whereby substantially all non-aromatic hydrocarbons are driven into the overhead of the modified EDC.

31. The process of claim 19 wherein the modified EDC employs a reboiler that is maintained at a temperature between 120 to 180° C. and a pressure between 1.0 to 2.0 Bar.

32. The process of claim 31 wherein the reboiler temperature is maintained at between 130 to 150° C. and the reboiler pressure is maintained between 1.0 to 1.5 Bar.

33. The process of claim 19 wherein the modified EDC is operated without a liquid reflux near the top of the column.

34. The process of claim 19 wherein the WWC is operated at a temperature of 20° to 100° C. and a pressure of 1.0 to 5.0 Bar.

35. The process of claim 34 wherein the WWC is operated at a temperature of 40° to 60° C. and a pressure of 1.0 to 2.0 Bar.

36. The process of claim 19 wherein the WWC is operated under a weight ratio of water-to-(solvent and raffinate) of 0.1 to 10.

37. The process of claim 36 wherein the WWC is operated under a weight ratio of water-to-(solvent and raffinate) of 0.5 to 5.

* * * * *